United States Patent [19]

Petter et al.

[11] Patent Number: 4,516,255

[45] Date of Patent: May 7, 1985

[54] ROTATING ANODE FOR X-RAY TUBES

[75] Inventors: Helmut Petter, Lechaschau; Hubert Bildstein; Fritz Simader, both of Reutte, all of Austria

[73] Assignee: Schwarzkopf Development Corporation, New York, N.Y.

[21] Appl. No.: 465,804

[22] Filed: Feb. 11, 1983

[30] Foreign Application Priority Data

Feb. 18, 1982 [AT] Austria ..... 618/82

[51] Int. Cl.[3] ..... H01J 35/08

[52] U.S. Cl. ..... 378/143; 313/311; 378/127; 378/144

[58] Field of Search ..... 378/127, 129, 143, 144; 313/311

[56] References Cited

U.S. PATENT DOCUMENTS

| | | | |
|---|---|---|---|
| 3,243,636 | 3/1966 | Nineuil | 378/129 |
| 3,836,807 | 9/1974 | Schreiner et al. | 378/144 |
| 3,919,124 | 11/1975 | Friedel et al. | 378/143 |
| 3,993,923 | 11/1976 | Magendans et al. | 378/129 |
| 4,000,434 | 12/1976 | Schreiner et al. | 378/144 |
| 4,090,103 | 5/1978 | Machenschalk et al. | 313/311 |
| 4,132,916 | 1/1979 | Hueschen et al. | 378/129 |
| 4,298,816 | 11/1981 | Hirsch et al. | 378/144 |
| 4,331,902 | 5/1982 | Magendans et al. | 378/144 |

*Primary Examiner*—Saxfield Chatmon

*Attorney, Agent, or Firm*—Morgan, Finnegan, Pine, Foley & Lee

[57] ABSTRACT

There is disclosed a rotating anode for use in X-ray tubes having a basic member made of a carbonaceous molybdenum alloy, such as TZM, and a focal path, that is a cathode path, of tungsten or a tungsten alloy, the surface of the basic member outside the focal path being coated at least partially with one or more oxides or a mixture of one or more metals and one or more oxides and having a 10 to 200 μm thick layer of molybdenum and/or tungsten disposed between the surface of the basic member and the coating thereon of oxides or mixture of metal and oxides.

5 Claims, 2 Drawing Figures

DEPENDENCE OF EMISSIVITY ON THE NUMBER OF EXPOSITIONS

ROTATING ANODE FOR X-RAY TUBES

BACKGROUND OF THE INVENTION

This invention relates to a rotating anode for X-ray tubes. More particularly, the invention relates to a rotating anode for X-ray tubes which has a basic member made of carbonaceous molybdenum alloy, such as TZM, and having a focal path, that is a cathode path, of tungsten or a tungsten alloy, the surface of the basic member outside the focal path being coated at least partially with one or more oxides or a mixture of one or more metals and one or more oxides.

The electric energy conveyed to a rotating anode in the production of X-rays is converted into X-ray radiation energy in the amount of appoximately only 1%. The remaining 99% is converted into undesirable heat, which leads to a heavy temperature load. For this reason, many attempts in the past have been made to carry off the thermal energy that is generated in rotating anodes as quickly as possible. In the main such attempts have involved increasing the surface thermal emissivity. Known ways of accomplishing this are coating of the rotating anode with graphite, with layers of pulverized refractory metals such as, for example, titanium or tantalum, or of carbides such as, for example, titanium carbide or tantalum carbide, or of oxide mixtures or oxide-metal mixtures.

West German Offenlegungsschrift No. 2443354 discloses a rotating anode of the kind mentioned above in which the basic member which may be made of TZM, for example, in order to increase the thermal radiation capability, is coated with a metal oxide layer of aluminum oxide and titanium oxide.

Austrian Pat. No. 336,143 likewise discloses a rotating anode having a basic member made of refractory metals, as well as, for example, molybdenum alloys and which anode is provided outside the focal path with a covering layer or coating of a composite of molybdenum and/or tungsten and/or niobium and/or tantalum with oxide ceramic materials, such as $TiO_2$ and/or $Al_2O_3$ and/or $ZrO_2$.

Therefore, in both of the above mentioned publications, carbonaceous molybdenum alloys are suggested or expressly mentioned as the basic material to be employed in the basic member. Hence, on the basis of these publications, it was obviously neither expected nor perceived by those skilled in the art that by employing a covering layer which was suitable in other cases, the expected thermal radiation increase lasting as long as the usual lifetime could not be achieved in the case of carbonaceous molybdenum alloys, especially TZM.

On the contrary, however, Applicants have found, altogether surprisingly, that in the case of rotating anodes having a basic member made of a carbonaceous molybdenum alloy, especially TZM, and which is furnished with a coating of oxides to increase the thermal radiation, exhibits severe deterioration of the originally good emission characteristics after the anode is in operation a short time. While this phenomenon is probably attributed to carbon diffusion from the basic member into the outer oxide layer, the negative influence on the thermal radiation capability still is not understandable, since it is just as well known and a usual procedure, according to the state of the art, to apply pure carbide layers, such as titanium carbide, to rotating anode basic members to increase thermal radiation.

There exists, therefore, a need for rotating anodes for X-ray tubes such as those mentioned above but which do not exhibit the disadvantageous properties thereof. It is, therefore, an object of this invention to produce a rotating anode for X-ray tubes having a basic member made of carbonaceous molybdenum alloys and in which an increased thermal emissivity is achieved independently of the length of time the anode is in operation.

THE DRAWING

In order to understand the present invention more fully, reference is directed to the accompanying drawing wherein in FIG. 1 there is illustrated a graph which shows the unexpected improvements with respect to thermal emissivity achieved with a rotating anode according to the invention as compared to a like anode without an intermediate layer.

FIG. 2 is an elevation view partially in cross section of a rotary anode showing the multilayer configuration of the present invention.

BRIEF STATEMENT OF THE INVENTION

In accordance with the invention, there is provided a rotating anode for X-ray tubes having a basic member made of a carbonaceous molybdenum alloy, such as TZM, and a focal path, that is a cathode path, of tungsten or a tungsten alloy, the surface of the basic member outside of the focal path being coated at least partially with one or more oxides or a mixture of one or more metals and one or more oxides and having a 10 to 100 μm thick layer of molybdenum and/or tungsten disposed between the surface of the basic member and the coating thereon of one or more oxides or a mixture of one or more metals and one or more oxides.

It is to be understood that TZM is a known molybdenum alloy containing about 0.5 to 1.5% by weight of titanium, about 0.5% by weight of zirconium and, optionally, about 0.3% by weight of carbon, the remainder being molybdenum.

DESCRIPTION OF THE PREFERRED EMBODIMENTS

As previously mentioned a rotating anode according to this invention has a 10 to 200 μm thick layer of molybdenum and/or tungsten disposed between the basic members and the outer coating thereon.

Figure 1:
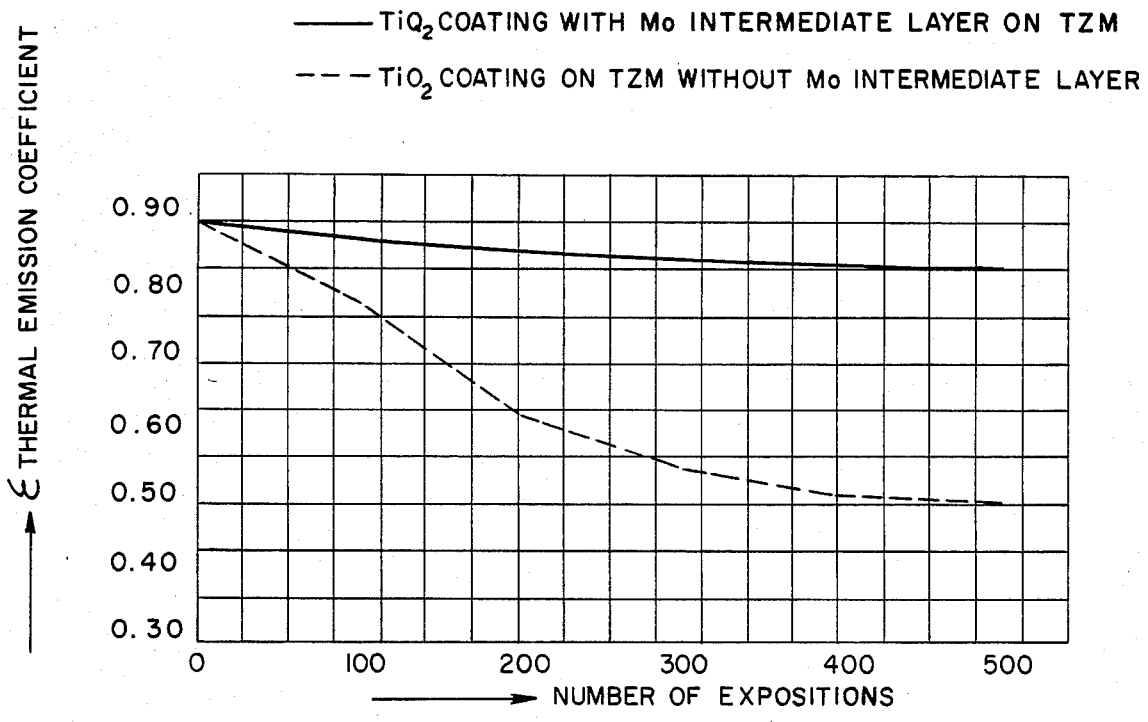
Figure 2:
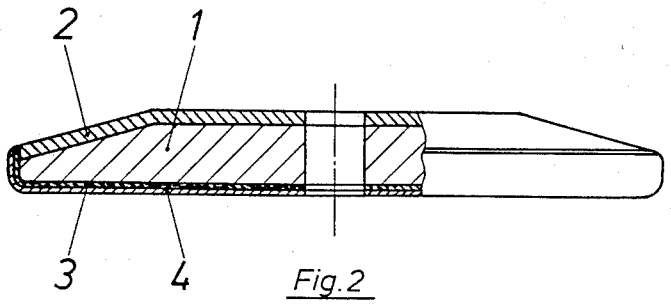

FIG. 2 shows a rotary X-ray anode with a basic member 1 of a carbonaceous molybdenum alloy such as TZM. In the area of the focal path on the upper side of the rotary anode an active layer (2) of tungsten or tungsten alloy is applied on the support body 1. The rest of the support member 1 is provided with an outer coating 4 of one or more oxides or of a mixture if one or more metals with one or more oxides for increasing the heat emissivity of the rotary anode. Between this outer coating 4 and the surface of the support member 1 an intermediate layer 3 of molybdenum or tungsten is applied.

The intermediate layer of molybdenum and/or tungsten prevents a deterioration of the thermal emission characteristics of the rotating anode which normally can be readily observed after a short time in operation. At the same time, the intermediate layer is an excellent adhesion agent, so that the covering layer adheres well to the basic member. Even assuming that the intermediate layer of molybdenum and/or tungsten serves as a diffusion barrier for carbon, the choice of these metals for that purpose is not obvious in view of a related problem area which has been very intensively investigated and described, that is the application of focal spot paths made of refractory metals to rotating anode basic members made of graphite. In such cases intermediate layers are required as carbon diffusion barriers. However, molybdenum and tungsten are considered less than suitable for this purpose and, instead, principally rhenium and individual platinum metals as well as carbides, nitrides, oxides an borides of Ti, Zr, Hf, Nb and Ta are recommended as intermediate-layer material.

For a rotating anode basic member, the molybdenum alloys such as TZM and TZC above all others have been tried and proven. The intermediate layer can be applied to the basic member, after the latter has been cleaned by sand blasting, by the usual coating processes, such as flame wire spraying, flame powder spraying or plasma spraying, in layer thicknesses between 10 and 200 μm, and preferably between 40 and 50 μm. The desired effect is not achieved with layer thicknesses of less than 10 μm and layer thicknesses of more than 200 μm are uneconomical to manufacture. Furthermore, thicknesses of more than 200 μm are unnecessary in order to achieve the desired effect and also are detrimental on the mechanical and thermal characteristics of such a rotating anode. The application of the outer oxide layer is done equally advantageously by flame powder spraying of plasma spraying. It is preferred after each of the two coatings to conduct an annealing treatment in a hydrogen atmosphere at 1600° C. for a duration of approximately a half hour.

The unexpected improvement exhibited by a rotating anode in accordance with the present invention is clearly evident as may be seen with the aid of the graph illustrated in the attached Drawings.

In the graph, the dependence of the thermal emissivity on the number of expositions, that is bombardments of rotating anodes with an electron beam, is shown. Two rotating anodes of like dimensions are compared with each other, one having a TZM basic member, an intermediate layer of molybdenum 10 μm thick and provided with a $TiO_2$ coating and one having a TZM basic member with a $TiO_2$ covering layer and no intermediate layer.

To determine the thermal emission coefficient, the rotating anodes, in an X-ray tube test stand, were each exposed to 500 expositions with a bombardment duration of 5.4 seconds at a tube voltage of 81 kV and a tube current of 300 milliamperes. A cooling-off phase of 5 minutes was maintained between the individual bombardments. After each 100 expositions, readings were taken via thermoelements and the cooling curves of the rotating anodes were plotted and from these readings the thermal emission coefficients are determined by conversion.

Both anodes shown an initial emission coefficient of about 0.9. In the case of the rotating anode without an intermediate layer of molybdenum, the emission coefficient after a small number of expositions falls sharply, and after about 500 expositions levels out of a value of about 0.5.

In contrast to this, in the case of the rotating anode with an intermediate layer of molybdenum, the emission coefficient declined only slightly with an increasing number of expositions and after about 500 expositions leveled out at about 0.83.

Like results are attained where an intermediate layer of tungsten is utilized and when the thickness of the intermediate layer is increased to 40, 50 and 200 μm.

It is, therefore, clearly seen that a rotating anode having an intermediate layer, in accordance with the invention provides a considerable improvement without the disadvantages which are exhibited by such a rotating anode which does not have an intermediate layer, apart from slightly increased production costs.

What is claimed is:

1. A rotating anode for x-ray tubes comprising:

a basic member comprised of a carbonaceous molybdenum alloy;

a focal path member comprised of tungsten or a tungsten alloy;

a coating layer disposed on at least part of said basic member comprised of at least one oxide, or of a mixture of at least one oxide and at least one metal; and an intermediate layer comprised of molybdenum, tungsten, or a mixture thereof, disposed between said basic member and said coating layer and being from 10 to 200 μm thick.

2. A rotating anode according to claim 1 wherein the basic member is made of molybdenum alloy containing about 0.5% to 1.5% by weight of Titanium, about 0.5% by weight of Zirconium and optionally about 0.3% by weight of carbon, the remainder being molybdenum.

3. A rotating anode according to claim 1 wherein the coating layer is comprised of $TiO_2$.

4. A rotating anode according to claim 1 wherein the intermediate layer is a layer of molybdenum.

5. A rotating anode according to claim 1 wherein the intermediate layer is a layer of tungsten.

* * * * *